United States Patent [19]

Chiang

[11] Patent Number: 4,731,173

[45] Date of Patent: Mar. 15, 1988

[54] ARTICLE FOR CONSTRUCTING AN ELECTROLYTIC CELL

[75] Inventor: John S. C. Chiang, Mercerville, N.J.

[73] Assignee: FMC Corporation, Philadelphia, Pa.

[21] Appl. No.: 932,832

[22] Filed: Nov. 20, 1986

[51] Int. Cl.[4] ..... C25B 9/00; C25B 13/02; C25B 13/08

[52] U.S. Cl. ..... 204/265; 204/266; 204/283; 204/295; 204/296; 429/142

[58] Field of Search ..... 204/265-266, 204/296, 283, 297 R, 295; 428/316.6, 315.5, 315.7, 315.9; 429/142

[56] References Cited

U.S. PATENT DOCUMENTS

| | | | |
|---|---|---|---|
| 3,454,477 | 7/1969 | Grangaard | 204/84 |
| 3,459,652 | 8/1969 | Grangaard | 204/294 |
| 3,462,351 | 8/1969 | Grangaard | 204/83 |
| 3,506,560 | 4/1970 | Grangaard | 204/263 |
| 3,507,769 | 4/1970 | Grangaard | 204/265 |
| 3,591,470 | 7/1971 | Grangaard | 204/84 |
| 3,856,640 | 12/1974 | Halfar et al. | 204/84 |
| 4,118,305 | 10/1978 | Oloman et al. | 204/265 |
| 4,170,539 | 10/1979 | Simmons | 204/296 X |
| 4,172,774 | 10/1979 | Moeglich | 204/296 X |
| 4,406,758 | 9/1983 | McIntyre et al. | 204/98 |
| 4,431,504 | 2/1984 | Seita et al. | 204/296 |
| 4,455,210 | 9/1984 | Coker et al. | 204/283 |
| 4,666,574 | 5/1987 | Oda et al. | 204/283 X |

OTHER PUBLICATIONS

Balej et al., "Electrochemical Reactors", *Fortsch Verfarenstech*, 22(D), pp. 361-389, (1984).

*Primary Examiner*—Donald R. Valentine
*Attorney, Agent, or Firm*—R. E. Elden; R. L. Anderson; E. G. Seems

[57] ABSTRACT

The present invention is a layered article of manufacture or quilt suitable to be useful to construct an electrolytic cell for manufacturing hydrogen peroxide. In use the quilt is placed upon a planar anode and the upper surface contacted with a current collector.

8 Claims, 1 Drawing Figure

ARTICLE FOR CONSTRUCTING AN ELECTROLYTIC CELL

Figure 1:
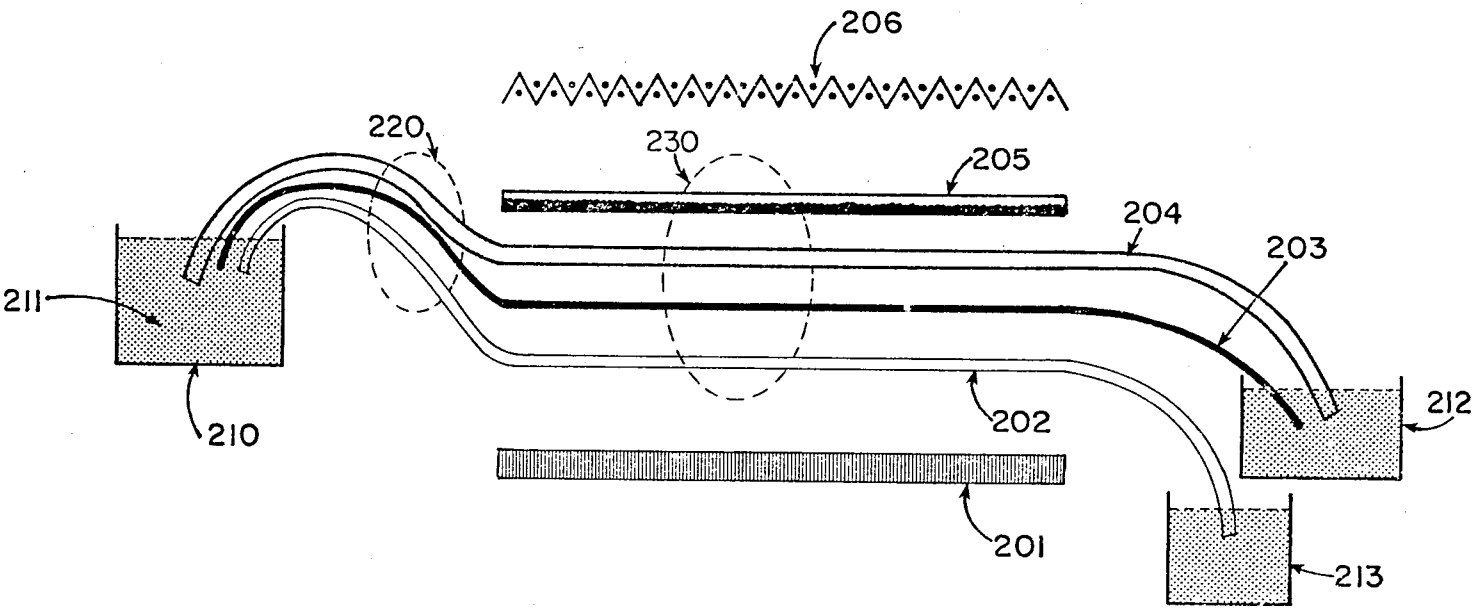

The present invention is an article of manufacture useful for constructing an electrolytic cell for reducing oxygen at a cathode.

For over a hundred years it has been known that oxygen can be reduced at a cathode in the presence of an aqueous alkali to form hydrogen peroxide. In spite of the very low voltage for the half cell reaction the process has never been commercialized. One reason for the lack of commercialization is that hydrogen peroxide is very unstable in the alkaline solutions, particularly in the presence of heavy metals. In addition, the very low solubility of oxygen in the alkaline solutions results in a very low maximum current density for the cells. Consequently, many of the earlier experiments were conducted with pure oxygen at a superatmospheric pressure and at 0° C.

U.S. Pat. Nos. 4,406,758 and 4,511,441 teach a method for operating an electrochemical cell employing a gas cathode. The electrolyte is introduced into the cell in the anode compartment where a gas such as oxygen or chlorine is formed. The electrolyte then passes through a separating means into a "trickle bed" or self-draining cathode. Oxygen gas is also introduced into the cathode and is reduced to form hydrogen peroxide. The hydrogen peroxide can optionally be decomposed or collected and employed as a bleach solution.

Both of these patents teach that the desired electrolytic reaction with gas will take place only where there is a three phase contact between a gas, an electrolyte solution and a solid electrical conductor. The patents teach that it is necessary to balance the hydraulic pressure of the electrolyte on the anode side of the separating means and on the cathode side of the separating means to maintain a controlled flow of electrolyte into the cathode and to maintain oxygen gas throughout the cathode. Pores of a sufficient size and number are provided in the cathode to allow both gas and liquid to flow simultaneously through the cathode. Both the patents admit that it is necessary to prevent the almost total filling of the cathode pores while at the same time preventing the almost total absence of electrolyte from the cathode pores. Consequently, the diaphragm separating means and self-draining cathode must be constructed and repaired at the use site by skilled workers making them impractical for use in a remote location.

Another problem with prior cells is that carbon cathodes suitable for reducing oxygen to hydrogen peroxide have relatively short lives ranging from 5 weeks to 5 years. The prior cells required employing skilled mechanics to rebuild the cells upon failure of a cathode.

In the presence of an alkali metal hydroxide the oxygen cathode overall reaction is the reaction of oxygen and water to form hydroxyl ions and perhydroxyl ions (anions of hydrogen peroxide, a very weak acid). The cathode reaction is $$2O_2+2H_2O+4e^-\rightarrow 2HO_2^-+2OH^- \quad (1)$$

and the anode reaction is $$4OH^-\rightarrow O_2+2H_2O+4e^- \quad (2)$$

with an overall reaction of $$O_2+2OH^-\rightarrow 2HO_2^- \quad (3).$$

In the absence of oxygen at the cathode that half cell reaction is $$2H_2O+4e^-\rightarrow H_2+2OH^- \quad (4).$$

Undesirable side reactions can also take place at the cathode $$HO_2^-+H_2O+2e^-\rightarrow 3OH^- \quad (5)$$

and at the anode $$HO_2^-+OH^-\rightarrow O_2+H_2O+2e^- \quad (6)$$

Consequently, it is important to avoid a local high concentration of the perhydroxyl ion ($HO_2^-$) from accumulating in the catholyte.

Equation (4) can predominate if the cathode does not contain oxygen gas or hydrogen peroxide (equation 5), this can occur either because the cell is flooded with electrolyte, or because the supply of oxygen is inadequate. In the absence of oxygen at the cathode hydrogen gas will be formed. The hydrogen gas may form an explosive mixture with the oxygen gas in the oxygen supply manifold. In the alternative, if insufficient oxygen were introduced into the cathode, hydrogen would be formed in the oxygen-depleted section which would mix with oxygen in the oxygen-rich zone to form an explosive mixture.

U.S. Pat. No. 4,118,305 to Oloman attempts to overcome the problems of balancing the hydrostatic forces to maintain a three-phase system of a solid electrode (cathode), a liquid electrolyte and oxygen gas by continuously flowing a mixture of oxygen gas and a liquid electrolyte through a fluid permeable cathode, such as, a porous bed of graphite particles. A porous separator separates the packed bed electrode from the adjoining electrode and is supported by the packed bed electrode. The pores of the separator are sufficiently large to allow a controlled flow of electrolyte into the openings of the packed bed electrode. However, installation of a packed bed electrode requires skilled workmen, making it impractical for use in a remote location. Further, mass transfer is a problem in such cells because the electrode is almost flooded with electrolyte. Reactions are slow and recycle of product is necessary for acceptable product strength, and recycle of the excess oxygen gas is essential for economic operation.

Copending application, Ser. No. 932,834 filed 11-20-86 teaches a cell overcoming many of the disadvantages of the prior art. The cell is a multi-layer construction having a generally horizontal anode serving as a base with a multi-layered assembly built upon the anode consisting of a first porous means, a separating means, a porous cathode and a current collector.

The present invention is an article of manufacture useful to construct an electrolytic cell suitable for the manufacture of hydrogen peroxide by the reduction of oxygen at a cathode comprising layers in sequence; a first nonconductive porous means inert to an alkaline liquid, a separating means, a second nonconductive porous means inert to an alkaline liquid containing hydrogen peroxide, and a porous cathode, said separating means being substantially permeable both to ions and to gases but being substantially impermeable to liquids, said first and second porous means being permeable to fluids, fastening means holding each of said layers in contact with a surface of the adjacent layer. The complete article of manufacture is referred to herein as a cell quilt.

An electrolytic cell employing the cell quilt is assembled by placing the cell quilt on a generally horizontal conductive anode. The cell quilt is disposed on top of the generally horizontal anode with the first porous means in contact with the anode. A current conducting means is placed on top of the cell quilt in electrical contact with the cathode on the upper surface of the cell quilt, said electrical conducting means provided with channels to permit a gas to contact the anode.

For the purpose of the present invention, the expression "substantially permeable both to an ion in the electrolyte and to a gas, but being substantially impermeable to the flow of the electrolyte from the cathode compartment to the anode compartment," shall be understood to mean that under normal operating conditions bubbles of oxygen gas generated at the anode can pass freely through the separating means from the anode compartment to the cathode compartment, but that very little electrolyte is transferred from the cathode compartment to the anode compartment. One commercially-available separating means suitable for the present invention is a hydrophillic laminate of polyester felt and an expanded polytetrafluoroethylene consisting of nodes and interconnecting fibrils. The laminate is marketed by W. L. Gore and Associates. The separating means is rated in a standard ASTM test F778 as 3.8 $m^3/5$ S at 125 Pa. The polyester felt portion of the laminate is suitable as either a first porous means or as a second porous means and serves to urge the anolyte to flow uniformly across the anode, or as the means to direct the electrolyte to flow uniformly across the cathode.

Another suitable separating means is a microporous polypropylene film $2.5\times10^{-2}$ mm thick having 38% porosity with an effective pore size of 0.02 micrometer which is marketed by Celanese Corporation. The pores provide the desired electrical conductivity but impede the flow of electrolyte. The film was perforated with openings without removing any material. The openings act as check valves and are spaced approximately every centimeter in a row and column matrix. The openings, for example, 0.5 mm slits, act as small bunsen valves which open to permit the flow of oxygen gas from the anode compartment into the cathode compartment and which close to exclude the flow of electrolyte from the cathode compartment to the anode compartment.

An ion conductive membrane, similarly punctured, is also suitable for use as a separating means. A typical commercial membrane is marketed by RIA Research Corporation under the tradename of Raipore BDM-10 membrane. It comprises a grafted low density polyethylene base film having a weak base cationic monomer as the graft.

The separating means employed in the present invention differ from the "ideal separating means" taught by the prior art in that it not only has a small mean pore size making it permeable to ions and not molecules, but also has openings of sufficient size to permit the passage of gas bubbles (gas openings) without permitting substantial diffusion or back mixing of hydrogen peroxide from the cathode compartment to the anode compartment. The optimum size, shape and distribution of the gas openings can be determined without undue experimentation. The shape of the openings may be straight slits, crosses, vees, or point punctures which are formed, desirably, without removing any material from the separating means. The separating means is usually installed so that the oxygen bubbles pass through it in the direction the punctures were formed. In this way the oxygen gas bubbles function as a part of the "valve".

The first and second porous means may be fabricated from any nonconductive material which is relatively inert to the alkaline aqueous electrolyte and to hydrogen peroxide. Suitable porous means may be fabricated from asbestos fabrics and mats, glass foams, glass fibers, vinyl fibers and foams, vinylidene fibers and foams, polyester fibers and foams, polytetrafluoroethylene and the like.

For the purposes of this invention, the term "generally horizontal" can include angles of up to about 45°. The rate of flow of electrolyte through the cell can be varied during operation by increasing or decreasing the angle of the cell from horizontal.

The first and second porous means may include any porous mass inert to the alkaline hydrogen peroxide. Preferably the first and second porous means are formed from felted inert fibers, woven inert fibers, knit inert fibers or an inert foamed material having interconnected pores.

Any suitable porous inert conductive material known to be useful as an oxygen electrode may be employed as a cathode, such as, a sheet of commercially available reticulated vitreous carbon employed in U.S. Pat. No. 4,430,176, porous graphite, or a composite electrode consisting of carbon particles bonded to an electrically conductive, porous base as taught by U.S. Pat. No. 3,459,652 in which the bonding agent is paraffin. Also suitable is an electrode of activated carbon bonded with PTFE and natural rubber onto a nickel screen taught by U.S. Pat. No. 4,142,949. Other electrodes known to be useful are taught by U.S. Pat. No. 3,856,640 employing carbon particles bonded with polytetrafluoroethylene and porous carbon electrodes suitable for fuel cells. It is desirable for the cathode to be flexible such as one employing graphite felt or woven or knit graphite fabric as a base for carbon particles such as any taught in French Patent Publication No. 2,493,878. Particularly desirable is a cathode employing a graphite base and employing carbon particles bonded with polytetrafluoroethylene as taught by copending application, Ser. No. 932,835 filing date 11-20-86.

The current conductor means may be an inert metal screen or grid. Although the current conductor means is desirably independent from the cathode it may be bonded to the cathode if desired.

The fastening means holding each of the layers of the cell quilt in contact with a surface of the adjacent layer may be any nonconductive fastening means, such as an adhesive, or a weld such as a spot weld or a linear weld. Other suitable fastening means include nonconductive staples, rivets, pins, snaps, hooks and the like. Fastening means employed fastening textiles such as, interlocking loop and pile and the like. A particularly desirable fastening means is by sewing the layers together with an inert thread or yarn. Preferably the sewing needle, should puncture the layers from the first porous means, through the separating means and second porous means and into the cathode. All of the layers may be fastened by the same fastening means or the layers of the cell quilt may be fastened individually to an adjacent layer.

The cell quilt is employed to form an electrolytic cell by placing the article of manufacture on an anode, such as a planar nickel sheet and the current conductor means applied over the cathode. The cathode and anode are conducted to a source of electrical power and electrolyte introduced into and through the cell by the "wicking" action of the porous means.

The invention is described in detail with reference to figures illustrating several embodiments.

FIG. 1 is a cross-section of a cell employing the cell quilt.

FIG. 1 is an exploded view of the elements of a cell. The elements, normally in contact with each other, comprise a nickel or stainles steel anode 201 forming the bottom of the cell surmounted by cell quilt 230, comprising sequentially by a first porous means 202, separating means 203, a second porous means 204, and porous cathode, 205 forming the upper surface of the cell exposed to a gas containing oxygen. Current collector 206, a nickel screen contacts the upper surface of quilt 230. Current collector 206 and anode 201 are connected to a negative and positive source of voltage (not shown).

In operation electrolyte 211 enters the cell from electrolyte reservoir 210 through the extension of porous means 202 and 204 which extensions form electrolyte inlet 220. Porous means 202 and 204 act as a wick and distribute the electrolyte uniformly over the surface of cathode 205 and anode 201. Anode 201 and nickel screen 206 are connected to a source of electricity (not shown). At anode 201, oxygen gas is formed which rises through anode compartment porous means 202 to the lower surface of separating means 203.

Bubbles of oxygen gas pass through gas opening separating means 203 into the cathode compartment porous means 204 and contact cathode 205. Additional oxygen gas also diffuses through cathode 205 to the surface of the electrolyte in cathode compartment in contact with porous means 204. There oxygen from both sources is reduced to form a solution of hydrogen peroxide in the electrolyte in the cathode compartment porous means 204. The electrolyte is urged from the electrolyte inlet across the surface of cathode 205 and anode 201 by the difference of static head of the surface of electrolyte 211 in electrolyte reservoir 210 and the low level of anolyte compartment porous means 202 and catholyte compartment 204 while they empty into electrolyte surge tanks 212 and 213.

The best mode of practicing the invention is exemplified by the following nonlimiting example.

Comparative Example

A cell was set up similar to FIG. 1 employing separate, unfastened layers, the electrolyte was 3.6% sodium hydroxide, and air scrubbed free of carbon dioxide was directed over the exterior surface of the cathode. The cell was operated for 5 hours at a current density of 0.025 A/cm$^2$. The current efficiency for an average of two runs was 96% producing an electrolyte containing an average of 0.93% $H_2O_2$.

Inventive Example

The comparative example was repeated but the assembly was stitched with nylon thread. Each stitch was about 10 cm apart. The cell was operated for 5 hours with a current efficiency of 96.4% and produced an electrolyte containing 0.95% $H_2O_2$.

What is claimed is:

1. An article of manufacture useful to construct an electrolytic cell suitable for the manufacture of hydrogen peroxide by the reduction of oxygen at a cathode, the article of manufacture comprising layers in sequence; a first nonconductive porous means inert to an alkaline liquid, separating means, a second nonconductive porous means inert to an alkaline liquid containing hydrogen peroxide, and a porous cathode, said separating means being substantially permeable both to ions and to bubbles of gases but being substantially impermeable to liquids, said first and second porous means being permeable to fluids, fastening means holding each of said layers in contact with a surface of the adjacent layer.

2. The article of claim 1 wherein the fastening means is an adhesive.

3. The article of claim 1 wherein the fastening means is a weld.

4. The article of claim 1 wherein the fastening means is a sewn stitch.

5. The article of claim 1 wherein the first and second porous means is selected from the group consisting of felted inert fibers, woven inert fibers, knit inert fibers and an inert foamed material with interconnecting pores.

6. The article of claim 1 wherein the separating means is a microporous polypropylene film with an effective pore size of 0.02 micrometer perforated with punctured openings to permit the passage of gas bubbles but being substantially impermeable to liquids.

7. The article of claim 1 wherein the separating means is an ion conductive membrane perforated with punctured openings to permit the passage of gas bubbles but being substantially impermeable to liquids.

8. An electrolytic cell employing the article of manufacture of claim 1, said electrolytic cell suitable for the manufacture of hydrogen peroxide comprising a generally horizontal conductive sheet suitable for use as an anode, said article of manufacture disposed on top of said anode with the first foraminous means in contact with the anode, and a current conducting means in electrical contact with the cathode of the article of manufacture, said electrical conducting means provided with channels to permit a gas to pass therethrough to contact the anode.

* * * * *